US005174653A

United States Patent [19]

Halat et al.

[11] Patent Number: 5,174,653

[45] Date of Patent: Dec. 29, 1992

[54] SERIAL CONNECTORS FOR MOTIONLESS MIXERS

[75] Inventors: Joseph M. Halat, Howell; Peter Gruendeman, Allentown, both of N.J.

[73] Assignee: TAH Industries, Inc., Robbinsville, N.J.

[21] Appl. No.: 769,084

[22] Filed: Sep. 30, 1991

[51] Int. Cl.[5] ..... B01F 5/06; F15D 1/02

[52] U.S. Cl. ..... 366/339; 138/37; 138/38

[58] Field of Search ..... 336/338, 339, 336, 337, 336/340; 138/38, 42, 37, 39; 165/109.1; 403/364, 354, 339, 340

[56] References Cited

U.S. PATENT DOCUMENTS

| | | | |
|---|---|---|---|
| 771,849 | 10/1904 | Utsler | 403/339 |
| 1,328,325 | 1/1920 | Hawkesworth | 403/339 |
| 1,331,776 | 2/1920 | Lewis | 403/339 |
| 1,439,002 | 12/1922 | Jourdan | 403/364 |
| 3,953,002 | 4/1976 | England, Jr. | 366/339 |
| 4,850,705 | 6/1989 | Horner | 366/338 |

FOREIGN PATENT DOCUMENTS

| | | | |
|---|---|---|---|
| 2232824 | 6/1973 | Fed. Rep. of Germany | 138/39 |
| 1060415 | 11/1953 | France | 403/354 |
| 2189107 | 1/1974 | France | 366/339 |
| 2337274 | 7/1977 | France | 403/364 |
| 1205123 | 9/1970 | United Kingdom | 403/354 |

*Primary Examiner*—Philip R. Coe
*Assistant Examiner*—Randall Edward Chin
*Attorney, Agent, or Firm*—Davis, Bujold & Streck

[57] ABSTRACT

The invention relates to motionless mixer elements having a plurality of connected baffles each with a pair of substantially symmetrical opposing major surfaces generally helically twisted along a central longitudinal axis of the baffle and an interconnection arrangement for serially releasably resiliently connecting such elements together on a common axis in desired orientations about that axis relative to one another.

19 Claims, 6 Drawing Sheets

SERIAL CONNECTORS FOR MOTIONLESS MIXERS

FIELD OF THE INVENTION

The present invention relates to serial connectors for in-line motionless mixing devices for intermixing a plurality of fluids generally referred to as motionless (static) mixers.

BACKGROUND OF THE INVENTION

Motionless mixers are static mixing devices generally used to intermix two viscous fluids. For example, one may wish to mix a thermoset, which consists of a resin and a hardener, e.g. epoxy. This can be done by simultaneously passing both the hardener and resin, in their liquid forms, into a conduit of a motionless mixer containing a multiplicity of baffles. As the fluids travel down through the bore of the conduit they are intermixed in stages corresponding to each baffle of the mixer.

Conventional motionless mixers are typically manufactured from plastic by injecting molding, thereby considerably reducing production costs when made on a large scale basis. Representative examples of such motionless mixers are disclosed in U.S. Pat. No(s). 3,286,992, 3,953,002, 3,635,444, 4,840,493 and 4,850,705. The plastic mixers are generally comprised of alternately right- and left-handed helically-curved baffles which are either individually disposed within a bore or are adjacently combined during manufacture to form a single unit insert which is disposed within a bore.

The injection molded motionless mixers are molded in discrete lengths which may comprise eight serially connected baffles. Mixing applications may require two or more of these motionless mixers to be used in series end to end to increase the desired level of mixing. It is known in such an arrangement to use indexing hubs on adjacent motionless mixer elements to position those elements rotationally relative to one another. However, these arrangements do not provide any means by which adjacent elements can be interconnected axially to maintain the elements firmly together.

It is an object of the present invention to provide a releasable interconnector arrangement capable of firmly connecting adjacent motionless mixer elements together axially while at the same time providing the desired rotational indexing to provide the desired angular relationship of one element to the other about their axes thereby to facilitate mixer assembly and disassembly together with retention of the serially connected mixer elements in the mixer housing.

SUMMARY OF THE INVENTION

According to the invention, there is provided a static mixer comprising a plurality of mixer elements defined by an interconnected plurality of baffles each helically twisted symmetrically about a longitudinal axis of the element and means for serially resiliently releasably interconnecting the elements to provide a connected series of elements which are indexed as desired relative to one another about those axes.

BRIEF DESCRIPTION OF THE DRAWINGS

The invention will now be described, by way of u example, with reference to the accompanying drawings, in which.

DESCRIPTION OF THE PREFERRED EMBODIMENT

Figure 1:
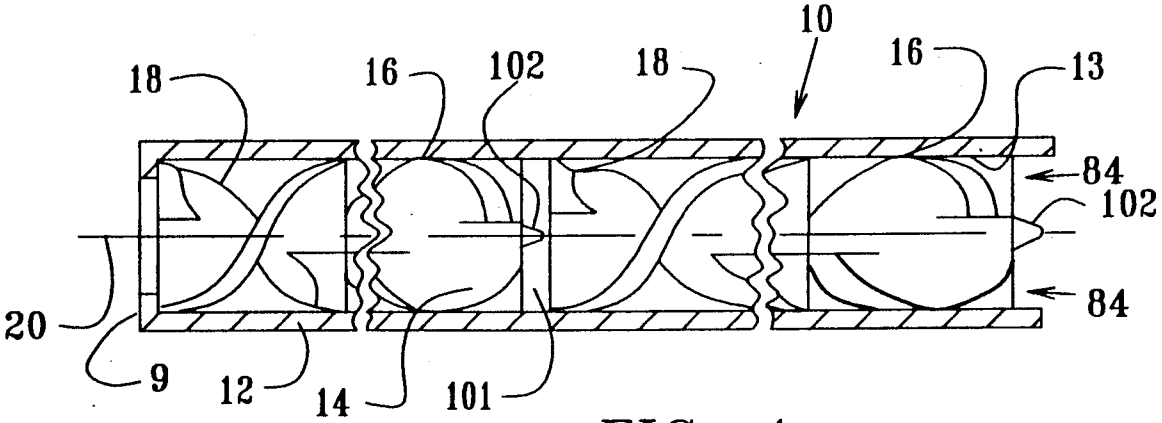
FIG. 1 is a partially sectioned fragmentary side elevation of a first embodiment of interconnected motionless mixer elements embodying principles of the present invention.

Referring to FIG. 1 a static mixer 10 comprises a tubular housing 12 defining a cylindrical bore 13 through which fluid may flow. Two serially related one piece (integrally formed) motionless mixer elements 14 are disposed in the bore 13 and is preferably injection molded from a thermoplastic material (e.g. polypropylene). Each element 14 is formed by a first subset of right-handed generally helically curved (twisted) baffles 16 which alternate with a second subset of left-hand generally helically curved (twisted) baffles 18 along a central longitudinal axis 20 of the element 14 and the bore 13. Each element 14 is a snug fit within the bore 13 and the elements are located by abutment of one element 14 with an annular lip 9 in the tubular housing 12.

The right-hand curved baffles 16 and left-hand curved baffles 18 of each element 14 are serially connected directly to one another by a continuous core 8. The central longitudinal axis of each baffle 16 and 18 is coaxial with the central longitudinal axis 20 of the insert.

Figure 2:
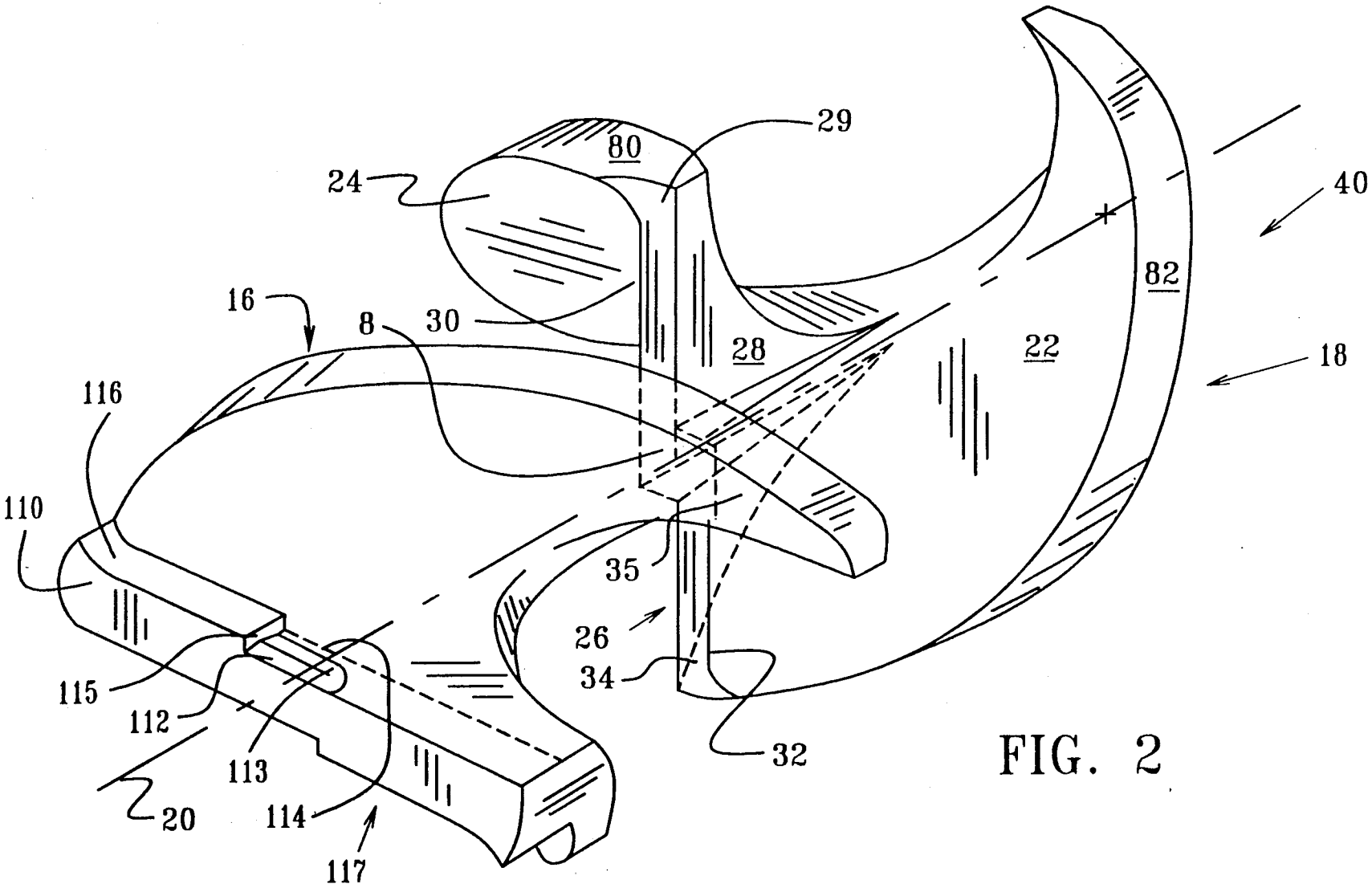
FIG. 2 is an isometric perspective view of a portion of a mixer element and connector of the first embodiment.

A typical right-hand, end, baffle 16 and the next adjacent (also typical), intermediate, left-hand baffle 18 are shown in FIG. 2. Referring first to the left-hand curved baffle 18, there are a pair of substantially symmetric opposing major surfaces 22 and 24 each generally concave in a plane normal to the axis 20 and helically curved left-handedly along the central longitudinal axis 20 through an angle of approximately 180°. Only a portion of the major surface 24 is visible in FIG. 2. A first pair of substantially planar surfaces 28, 29 disposed normal to one another connect the pair of major surfaces 22 and 24 on the near end 26 of the baffle 18. The intersection of the planar surface 29 with the major surface 24 forms a first edge 30 at the near end 26 of the baffle. A second edge 32 is provided at the near end 26 by the intersection of the major curved surface 22 with a surface 34 of a second pair of substantially planar surfaces 34, 35, similar to surfaces 28, 29 and also disposed normal to one another. Each of the pairs of substantially planar surfaces connect the major surfaces 22 and 24 at the near end 26 of the baffle 18. Each of the planar surfaces 28 and 35 extends both substantially normal to and lies in a plane substantially parallel to the central longitudinal axis. These surfaces 28 and 35 extend on opposite sides of axis 20, are parallel and tangential to a central core 8 (shown in ghost) which extends along said axis 20 and is common to and joins together all baffles 16 and 18 Hence, each of the first and second planar surfaces 28 and 35 and each of their edges 30 and 32 is radially displaced from the central longitudinal axis 20 on opposing sides of the central longitudinal axis 20. The surfaces 28 and 35 both face a plane through which passes the axis 20. At the opposite end 40 of the baffle 18 the pair of opposing major curved surfaces 22 and 24 are connected by similar pairs of substantially planar surfaces respectively similar to but oppositely oriented to surfaces 28, 29 and 34, 35 to define edges oppositely oriented to edges 30 and 32. These similar planar surfaces extend both substantially normal to axis 20 and lie in a plane substantially parallel to the axis 20 and are radially displaced from the axis 20 on opposing sides thereof.

Each end 26 and 40 of each of the depicted left-hand curved baffle 18 adjoins an end of a right-hand curved baffle 16. One such baffle 18 is depicted in FIG. 2. The right-hand baffle 16 has a pair of opposing major surfaces helically curved right-handedly along the central axis 20 through an angle of approximately 180°. The usual, intermediate, baffle 16 is essentially the mirror image of baffle 18 when the image reversal is along the axis 20. However, baffle 16 shown in FIG. 2 is modified to accommodate the interconnection arrangement of the present invention. The baffles are connected by central core 8 and are disposed at an angle to each other, about axis 20, of 90°.

Referring again to FIG. 2 the baffle 18 includes a pair of circumferential opposing minor surfaces 80 and 82, generally right-hand helically curved along the central axis 20, which are formed to sit flush against an inner wall of the housing 12 forming the cylindrical bore 13 The right-hand baffle 16 includes a similarly oppositely helically curved pair of minor opposing curved surfaces.

In operation, a pair of fluids are introduced into the device 10 onto the opposing major curved surfaces of the lead baffle. This is indicated diagrammatically in FIG. 1 assuming the furthest right left-hand curved baffle 18 is the lead baffle of the element 14. The pair of fluids are indicated by arrows 84. The alternating helical motion imparted to the fluids with repeated divisions and recombinations of different portions and velocities thereof by the subsequent baffles creates enhanced intermixing. The fluid path within each element is divided into two symmetrical semicircular passageways. Near the end of the element, the passageways alter into asymmetric passageways, having been shifted around the center core in a cartwheel fashion. This cartwheel geometry is such that the pair of leading edges of each of the right-hand baffles 16 and left-hand baffles 18 are offset with the pair of trailing edges of the adjacent left-hand baffle 18 or right-hand baffle 16, respectively.

In addition, the narrow edges of the leading or leading and trailing edges of the baffles 16 and 18 increases the cross-sectional area available for flow at the junction of adjacent baffles and creates velocity gradients that increase the fluid area available for splitting the flow. These edges also eliminate the tendency of fluids to accumulate on the edges of the baffles 16 and 18, which would decrease mixing efficiency and possibly completely block fluid flow through the mixer 10. In addition offsetting the edges enable the mixer insert 14 to be injection molded using only a pair of mold halves. This simplifies considerably the injection molding of the insert and minimizes its cost.

Figure 9:
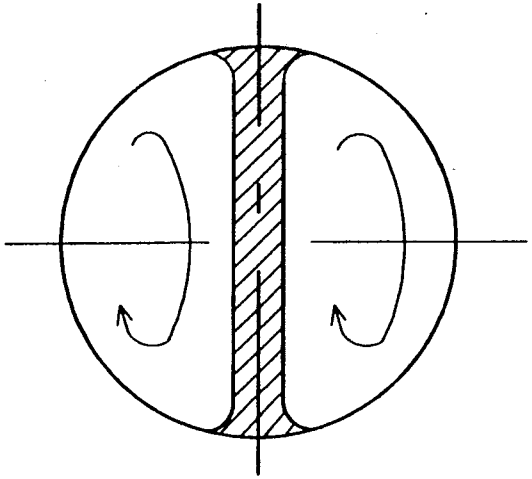
FIG. 9 is a diagrammatic typical cross-section of a baffle in a housing illustrating the ovoid cross-section of the passages formed thereby.

The cross-section of the baffles 16, 18 is shaped to form, with tubular housing 12, a pair of generally ovoid (substantially or generally elliptical) cross-section passages (FIG. 9). This is achieved by adding concave fillets to the otherwise generally rectangular cross-section of the baffles. By doing this the sharp corners adjacent the bore 13, where previously little or no mixing occurred, are eliminated and the same mixing efficiency can be maintained with a length/diameter (L/D) of between 0.8:1 and 0.7:1 (even as low as 0:5:1 might be usable) as was previously achieved with L/D ratios exceeding 1. The modified baffle cross-section provides major surfaces which are generally concave in cross-section normal to the axis 20.

Although the invention has been described with respect to a preferred embodiment mixer incorporating a one-piece plastic molded insert, individual baffles of the described geometry can be positioned within a passageway to form a mixer enjoying at least some of the advantages of the disclosed preferred embodiment. Moreover, although the baffles 16 and 18 of the preferred embodiment insert are immediately adjoining one another, spacers could be provided between the baffles along the central longitudinal axis 20 of the insert 14 to coaxially separate the adjoining trailing edges and leading edges of adjoining baffles pairs. Similarly, although narrow edges are provided at the leading and trailing edges of each of the baffles of the preferred embodiment, some advantages of the subject invention can be enjoyed by employing edges on only one of the leading and trailing sides of each baffle or on less than all the baffles of an insert or in a static mixer.

The present invention provides an interconnection arrangement for releasably interconnecting adjacent serially positioned elements 14 axially and to index them rotationally relative to one another to provide a desired relative orientation of baffles the two elements about their axes.

Figure 3:
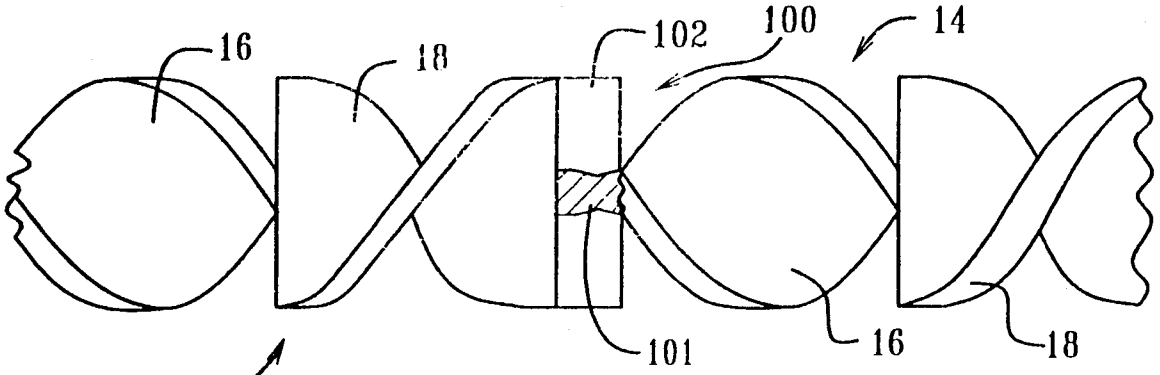
FIG. 3 is a side elevation of a portion of the motionless mixer elements of FIG. 1 showing in greater detail the interconnection thereof.

With reference first to FIG. 3 two motionless mixer elements 14 each comprising baffles 16, 18 are connected by an interconnection arrangement 100 which comprises a male portion 101 in the form of a flange 110 extending axially from the end face of the baffle 16 of the element 14 on the right, the flange being disposed symmetrically about the axis 20. The right-hand element 14 carries a female portion 102 of the interconnection arrangement in the form of a flange 103 extending axially from the end face of baffle 18 of the element 14 on the left toward the right-hand element 14 for engagement with the male portion 101. The flange of the female portion 102 is symmetrically disposed about the axis 20. The portions 101 and 102 snap together in resilient releasable engagement with one another with the force of engagement being sufficient to maintain the elements in serial interconnection with one another except when their separation is desired. The interconnection of the portions 101 and 102 is arranged the align the elements 14 coaxially with the axis 20 and to index the elements 14 whereby the aforementioned end face of the baffles 16 and 18 are located at 90° to one another to provide the desired relative orientation of the baffles of the elements.

Figure 4:
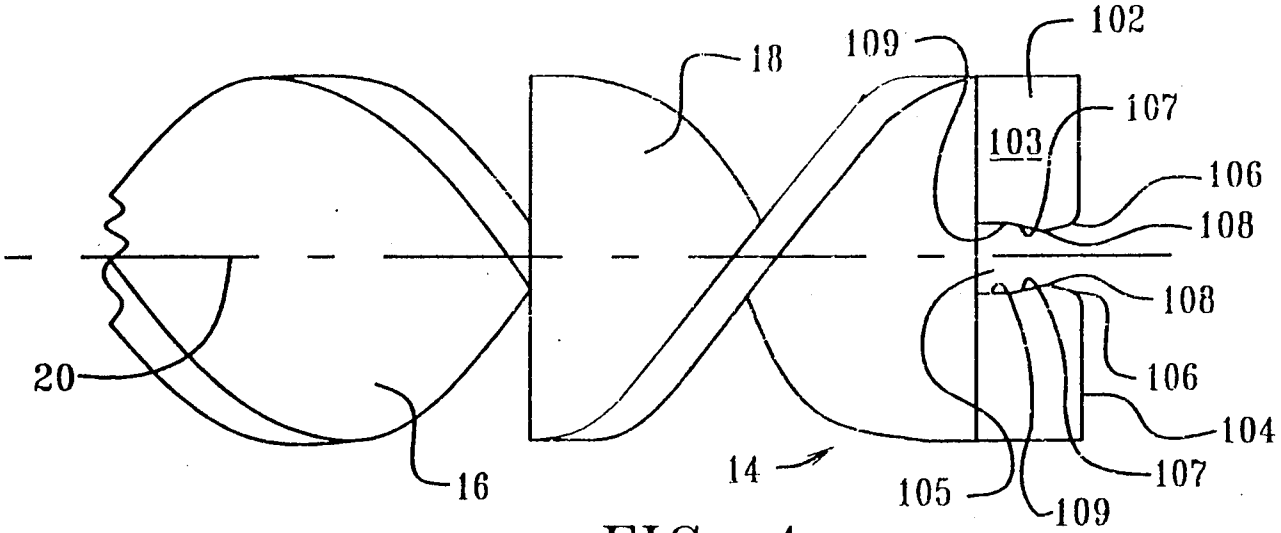
FIG. 4 is a side elevation of the motionless mixer element on the left of FIG. 3 showing in greater detail a female part of the interconnection arrangement.
Figure 5:
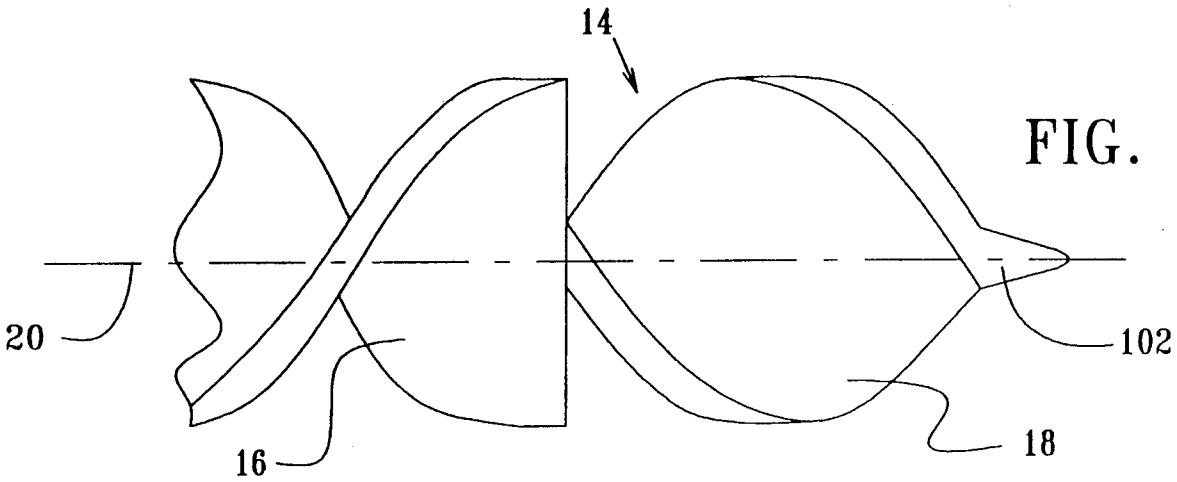
FIG. 5 is a fragmentary plan view of the element illustrated in FIG. 4.
Figure 6:
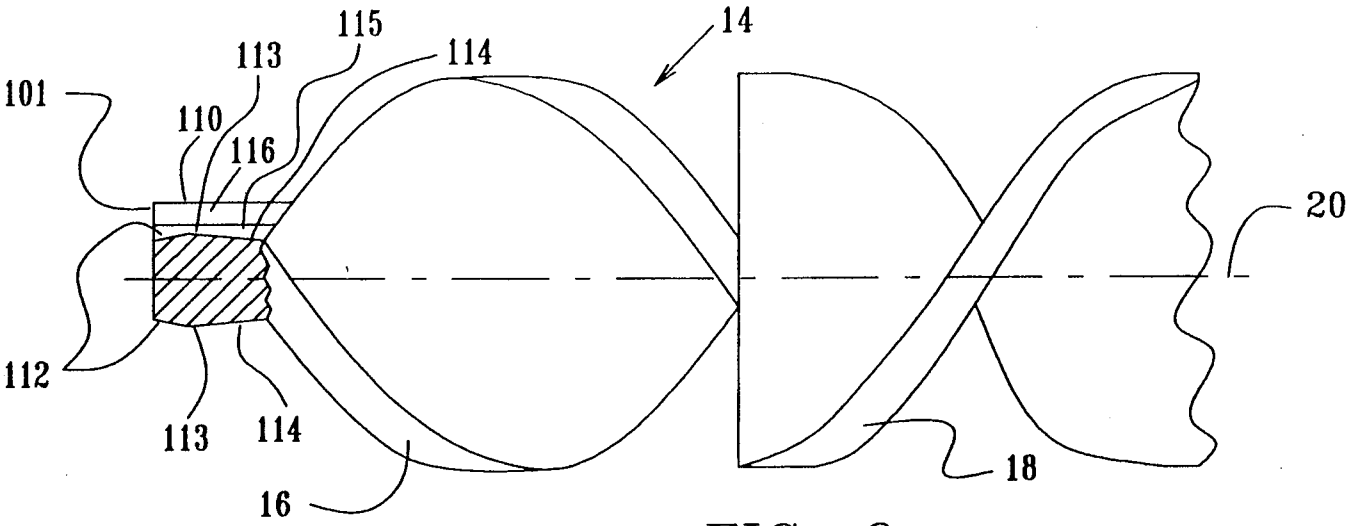
FIG. 6 is a side elevation of the element on the right of FIG. 3 illustrating in greater detail a male part of the interconnection arrangement.
Figure 7:
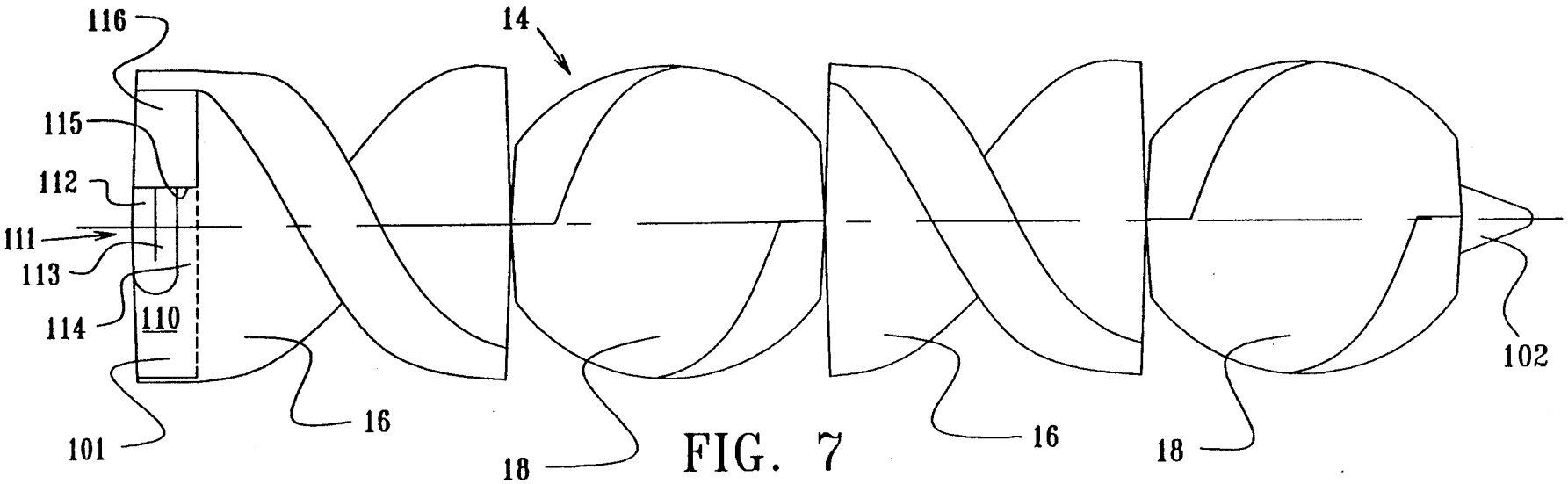
FIG. 7 is a plan view of the element illustrated in FIG. 6.
Figure 8:
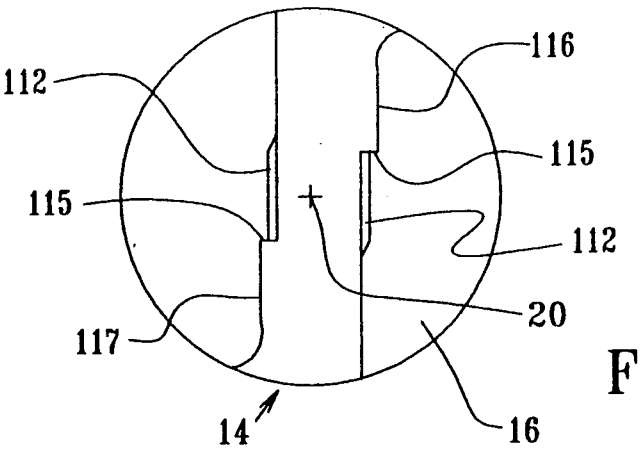
FIG. 8 is an end view of the male part illustrated in FIG. 6.

The interconnection arrangement 100 will now be described in greater detail with reference to FIGS. 4 through 8 with FIGS. 4 and 5 illustrating the female portion 102 and FIGS. 6, 7 and 8 illustrating the male portion 101. First with respect to FIGS. 4 and 5, the flange 103 of the female portion 102 has a triangular cross-section (FIG. 5) which terminates in an edge 104. Symmetrically located on the axis 20 is a slot 105 extending through the full thickness of the flange 103. The slot is of a re-entrant shape comprising a first entrance portion, defined by surfaces 106, converging inwardly from the edge 104 toward the baffle 18 to define with oppositely converging surfaces 107 a throat 108. The converging surfaces 107 are connected to the base of the slot by parallel surfaces 109. The flange 103 is integrally formed with the left-hand element 14 and the material from which elements 14 are manufactured is chosen not only for its suitability for use in the environment to which it will be exposed but also to have a resilience appropriate for the interconnection arrangement.

The male portion 101, illustrated in FIGS. 6, 7 and 8 comprises a flange 110 having a central portion 111 shaped to engage the flange 103 and slot 105 to connect the flanges 103 and 110 resiliently to one another while at the same time locating those flanges laterally and longitudinally thereof with respect to one another. This is achieved by providing the central portion with surfaces 112, 113, 114 which are complimentary to the surfaces 106, 107 and 109 of the flange 103 to provide for engagement of the central portion 110 within the slot 103 with surfaces 113 and 107 in engagement to resiliently hold the elements together axially of one another.

The central portion 111 is defined and terminated along the flange 110 by surfaces 115 one on each of the opposite faces 116 and 117 of the flange 110. The surfaces 115 are disposed opposite one another relative to the axis 20 and extend substantially normal to the length of the flange 110 to provide a pair of locating surfaces with which the flange 103 is engaged when the central portion 111 engages the slot 105.

As will be apparent to any man of ordinary skill in this technology the choice of materials and dimensions of the interconnection arrangement 100 will be chosen to provide the desired connecting force between the adjacent elements 14 while providing for the separation of those elements when desired.

It will be appreciated (see FIG. 7) that individual elements 14 may be manufactured with a male portion 101 at one end of the element and a female portion 102 at the other end of the element, the flanges of these portions being oriented 90° to one another whereby a plurality of substantially identical such elements may be interconnected serially as previously described. It will also be appreciated that the triangular cross-section of the female portion 102 lends the construction to a preference for the flow of materials, to be mixed, in the direction 84 to be toward the female portion thereby to reduce restriction of flow as it passes the junction between elements.

From the foregoing description, it can be seen that the present invention provides an easily manufactured and superior performing static mixer. It will be recognized that although certain modifications have been suggested, other changes could be made to the above-described invention without departing from the broad inventive concepts thereof. It is understood, therefore, that the invention is not limited to the particular embodiment(s) disclosed, but is intended to cover any modifications which are within the scope and spirit of the invention as defined by the appended claims.

The second embodiment is illustrated in FIG. 10 through 15. In this embodiment two motionless mixer elements 14 each comprising baffles 16, 18 can be connected by an interconnection arrangement 200 which comprises a male portion 201 in the form of a flange 210 extending axially from the end face of the baffle 16 of the element 14 on the right, the flange being disposed symmetrically about the axis 20. The right-hand element 14 carries a female portion 202 of the interconnection arrangement in the form of a flange 203 extending axially from the end face of baffle 18 of the element 14 on the left toward the right-hand element 14 for engagement with the male portion 201. The flange of the female portion 202 is symmetrically disposed about the axis 20. The portions 201 and 202 snap together in resilient releasable engagement with one another with the force of engagement being sufficient to maintain the elements in serial interconnection with one another except when their separation is desired. The interconnection of the portions 201 and 202 is arranged the align the elements 14 coaxially with the axis 20 and to index the elements 14 whereby the aforementioned end face of the baffles 16 and 18 are located at 90° to one another to provide the desired relative orientation of the baffles of the elements.

Figure 10:
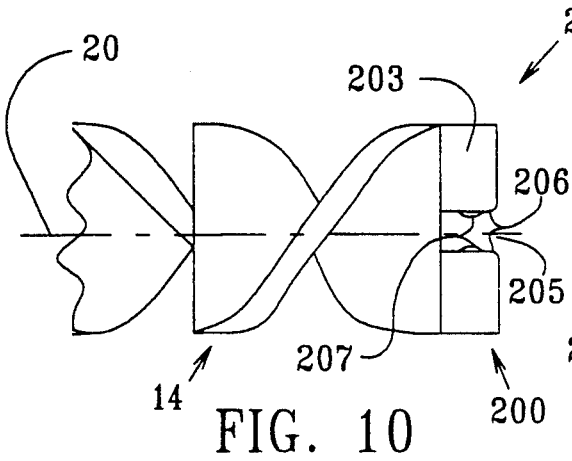
FIGS. 10 through 15 illustrate a second embodiment of the present invention with FIGS. 10 through 14 corresponding to the views illustrated in FIGS. 4, 5, 6, the left side portion of 7 and 8 and with FIG. 15 being an end view of the female part illustrated in FIG. 10.
Figure 12:
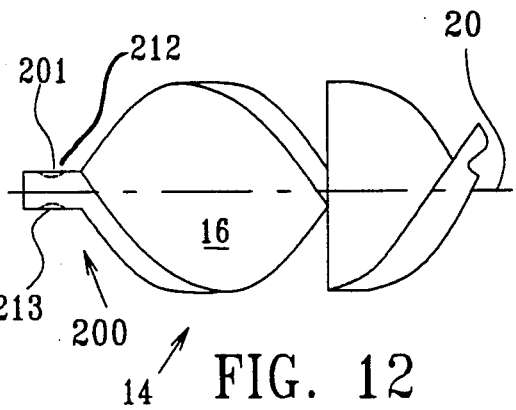
Figure 11:
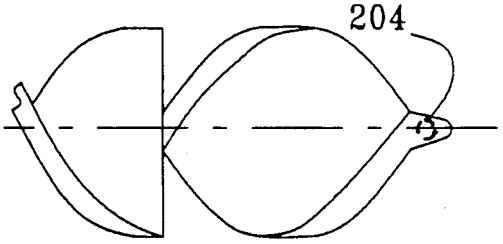
Figure 13:
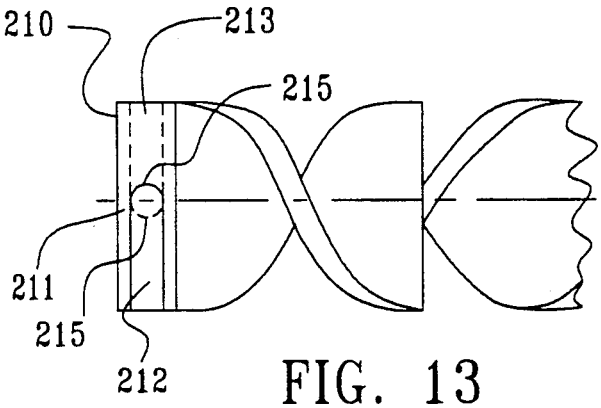
Figure 15:
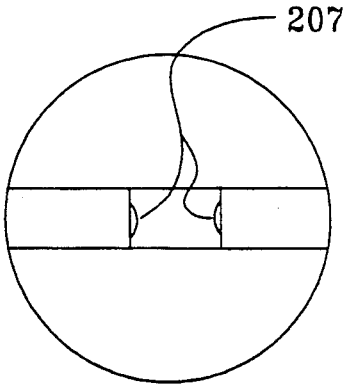
Figure 14:
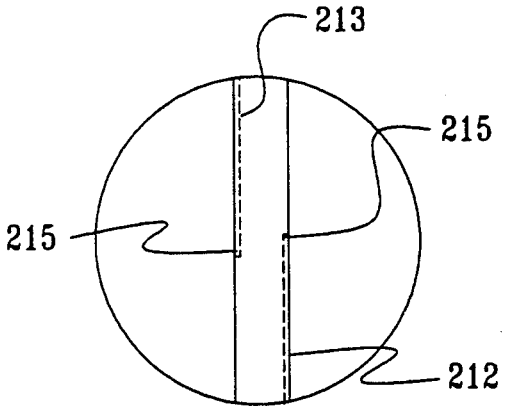

The interconnection arrangement 200 will now be described in greater detail FIGS. 10, 11 and 15 illustrate the female portion 201 and FIGS. 12, 13 and 14 illustrate the male portion 202. First with respect to FIGS. 10, and 15, the flange 203 of the female portion 202 has a triangular cross-section (FIG. 11) which terminates in an edge 204. Symmetrically located on the axis 20 is a slot 205 extending through the full thickness of the flange 203. The slot is of a re-entrant shape comprising a first defined by surface 206. The surfaces 206 are connected to the base of the slot. Detents 207 project from the surfaces 206. The flange 203 is integrally formed with the left-hand element 14 and the material from which elements 14 are manufactured is chosen not only for its suitability for use in the environment to which it will be exposed but also to have a resilience appropriate for the interconnection arrangement.

The male portion 201, illustrated in FIGS. 12, 13 and 14 comprises a flange 210 having a central portion 211 shaped to engage the flange 203 and slot 205 to connect the flanges 203 and 210 resiliently to one another while at the same time locating those flanges laterally and longitudinally thereof with respect to one another. This is achieved by providing the central portion with grooves 212, 213, extending transversely of axis 20 one on each face of flange 210 one from each opposite end of flange 210. The grooves overlap in the central portion. The grooves 212, 213 are complimentary to the detents 207 of the flange 203 to provide for engagement of the central portion 210 within the slot 203 with grooves 212, 213 and detents 207 in engagement to resiliently hold the elements together axially of one another.

The central portion 211 is defined and terminated along the flange 210 by the closed ends 215 of the grooves 212, 213. The closed ends 215 are disposed opposite one another relative to the axis 20 to provide a pair of locating surfaces with which the detents 207 of flange 203 is engaged when the central portion 111 engages the slot 205.

As will be apparent to any man of ordinary skill in this technology the choice of materials and dimensions of the interconnection arrangement 200 will be chosen to provide the desired connecting force between the adjacent elements 14 while providing for the separation of those elements when desired.

While the description of the invention has focused on the interconnection of mixer elements it will be appreciated that the connection of flow accessories to mixer elements by the resiliently releasable interconnecting means of the invention is also contemplated. Accordingly, as used herein the term "mixer element" shall be construed to include mixer flow accessories, such as, premixers, check valves, positioning flanges.

We claim:

1. A motionless mixer comprising:

a plurality of mixer elements defined by an interconnected plurality of baffles each helically twisted symmetrically about a longitudinal axis of the element and means for serially resiliently releasably interconnecting the elements to provide a connected series of elements which are indexed as desired relative to one another about those axes with each so connected pair of elements being restrained by the interconnecting means whereby their longitudinal axes are coincident when aligned, said interconnecting means resiliently releasably interconnecting the elements to resist longitudinal separation from one another.

2. A motionless mixer according to claim 1 comprising a plurality of elements serially arranged along said axis with the end baffles of adjacent elements being of oppositely handed helical twist with adjacent baffles being oriented approximately 90° apart relative to one another about said axis.

3. A motionless mixer comprising:

a plurality of mixer elements defined by an interconnected plurality of baffles each helically twisted symmetrically about a longitudinal axis of the element and means for serially resiliently releasably interconnecting the elements to provide a connected series of elements which are indexed as desired relative to one another about those axes with each so connected pair of elements being restrained by the interconnecting means whereby their longitudinal axes are coincident when aligned, wherein the means for interconnecting the elements comprises a male portion and a female portion with said female portion defining a slot shaped to captively engage in a resiliently releasable manner the male portion, means being provided for ensuring that engagement only occurs when the longitudinal axes are aligned with the elements in the desired orientation relative to one another about those axis.

4. A motionless mixer according to claim 3 wherein the female portion defines a slot, in a flange, having a converging entrance which joins a diverging portion of the slot interiorly of the entrance thereto, said converging and diverging portions together defining a throat with which a corresponding portion of the male portion engages to provide said resilient releasable engagement.

5. A motionless mixer according to claim 4 wherein said male portion comprises surfaces complimentary to the converging and diverging portions of the slot of the female portion whereby said engagement between the elements is facilitated.

6. A motionless mixer according to claim 5, wherein the male portion comprises a flange integrally formed with a said element and defining opposed surfaces, said flange having a length, and wherein the means for maintaining at least one of intersecting and coincident axes between adjacent pairs the interconnected plurality of baffles comprises a locating surface extending from each of the opposed surfaces substantially normal to the length of the flange, the locating surfaces being parallel and oppositely oriented to one another and arranged together to engage the portion of the flange of the female portion defining the slot to ensure, together with the converting and diverting surfaces, alignment of said longitudinal axes.

7. A motionless mixer according to claim 6 wherein said flanges extend transversely of said longitudinal axes and are symmetrically disposed about those axes, the flanges forming extensions of outer ends of the baffles of the elements.

8. A motionless mixer according to claim 7 wherein each element defines first and second element ends with the first element end carrying a said male portion and the second element end carrying a said female portion whereby all elements forming a series of interconnected elements are identical to one another.

9. A motionless mixer according to claim 3 wherein each element defines first and second element ends with the first element end carrying a said male portion and the second element end carrying a said female portion whereby all elements forming a series of interconnected elements are identical to one another.

10. A motionless mixer according to claim 3 wherein the female portion defines a slot, in a flange, defined by opposite surfaces having detents thereon interiorly of the entrance to the slot, said detents together defining a throat with which a corresponding portion of the male portion engages to provide said resilient releasable engagement.

11. A motionless mixer according to claim 10 wherein said male portion comprises surfaces complimentary to the detents of the slot of the female portion whereby said engagement between the elements is facilitated.

12. A motionless mixer according to claim 11 wherein the male portion comprises a flange integrally formed with a said element and defining opposed surfaces in each of which extends a locating groove extending substantially normal to the length of the flange, the locating grooves being parallel and oppositely oriented to one another and arranged to engage the detents of the flange of the female portion defining the slot to ensure alignment of said longitudinal axes.

13. A motionless mixer element comprising an interconnected plurality of baffles each helically twisted symmetrically about a longitudinal axis of the element and defining a first element end and a second element end, the first element end defining a female portion of an element interconnection arrangement and the second element end defining a male portion of an element interconnection arrangement whereby a plurality of such elements may be connected in series with the female portion of one said element engaging the male portion of another said element to resiliently releasably connect those elements in series with their longitudinal axes aligned and with the baffles of these serially connected elements indexed as desired relative to one another about those longitudinal axes.

14. A motionless mixer according to claim 13 wherein the female portion defines a slot, in a flange, having a converging entrance which joins a diverging portion of the slot interiorly of the entrance thereto, said converging and diverging portions together defining a throat with which a corresponding portion of the male portion engages to provide said resilient releasable engagement.

15. A motionless mixer according to claim 14 wherein said male portion comprises surfaces complimentary to the converging and diverging portions of the slot of the female portion whereby said engagement between the elements is facilitated.

16. A motionless mixer according to claim 15 wherein the male portion comprises a flange integrally formed with a said element and defining opposed surfaces from each of which extends a locating surface extending substantially normally to the length of the flange, the locating surfaces being parallel and oppositely oriented to one another and arranged together to engage the portion of a flange of the female portion defining the slot to ensure, together with the converging and diverging surfaces alignment of said longitudinal axes.

17. A motionless mixer according to claim 16 wherein said flanges extend transversely of said longitudinal axes and are symmetrically disposed about those axes, the flanges forming extensions of outer ends of the baffles of the elements.

18. A motionless mixer having a plurality of elements according to claim 13, the elements serially arranged along said axis with the end baffles of adjacent elements being of oppositely handed helical twist with adjacent baffles being oriented approximately 90° apart relative to one another about said axis.

19. A motionless mixer comprising a plurality of elements according to claim 13 and a cylindrical tube having an inner surface defining a cylindrical bore, the elements being interconnected by said male and female portions, each of said elements being in intimate contact with said inner surface from its first end to its second end to define two separate substantially equally sized helically curved passages of substantially ovoid cross-section.

* * * * *